US006393620B2

(12) United States Patent
Hatch et al.

(10) Patent No.: US 6,393,620 B2
(45) Date of Patent: May 28, 2002

(54) PARTIAL SOCK

(75) Inventors: Joy S. Hatch, Wilmington; Robert Craddock; Cindy Jones Dickson, both of Mount Airy, all of NC (US)

(73) Assignee: Renfro Corporation, Mount Airy, NC (US)

( * ) Notice: Subject to any disclaimer, the term of this patent is extended or adjusted under 35 U.S.C. 154(b) by 0 days.

(21) Appl. No.: 09/888,723

(22) Filed: Jun. 25, 2001

Related U.S. Application Data

(60) Provisional application No. 60/214,614, filed on Jun. 28, 2000.

(51) Int. Cl.[7] ..... A41B 11/00
(52) U.S. Cl. ..... 2/239; 2/409
(58) Field of Search ..... 2/239, 409, 1; 36/110, 112, 113, 136, 7.1 R, 7.2, 9 R, 9 A, 10, 70 R; 66/170, 171, 178 R–182, 185–187, 189, 190

(56) References Cited

U.S. PATENT DOCUMENTS

| | | | | | |
|---|---|---|---|---|---|
| 1,726,441 | A | * | 8/1929 | Loven | 2/239 |
| 2,248,303 | A | * | 7/1941 | Morgenroth et al. | 2/239 |
| 2,391,064 | A | * | 12/1945 | McCandless | 2/239 |
| 2,412,087 | A | * | 12/1946 | Herbert | 2/239 |
| 2,687,528 | A | * | 8/1954 | Paul | 2/239 |
| 2,703,405 | A | * | 3/1955 | Smallberg, Sr. | 2/239 |
| 3,334,356 | A | * | 8/1967 | Abel | 2/239 |
| 3,487,830 | A | * | 1/1970 | Pruett | 2/239 |
| 3,887,946 | A | | 6/1975 | Laskin et al. | |
| 6,044,497 | A | | 4/2000 | Richardson | |
| D432,777 | S | | 10/2000 | Lotti | |

OTHER PUBLICATIONS

Package of "Peds Toe Covers,"manufactured by Americal Corporation, P.O. Box 1419, Henderson, N.C. 27536, in existence at least as of Jun. 25, 2001.

Nike Air Max Craze Shoe (Women, Style No. 174254) Advertisement, http://niketown.nike.c.../mwk_prod_productdetail.jtml?categoryld=50633&productIndex×, in existence at least as of Jun. 25, 2001.

Nike Air Visi Havoc Shoe (Women, Style No. 174258) Advertisement, http://niketown.nike.c.../mwk_prod_productdetail.jtml?categoryld×50633&productIndex×, in existence at least as of Jun. 25, 2001.

* cited by examiner

*Primary Examiner*—Gloria M. Hale
(74) *Attorney, Agent, or Firm*—Kilpatrick Stockton LLP

(57) ABSTRACT

An article of apparel for a foot that covers the forward portion of the foot only does not show above the tops of shoes and enhances fit and comfort of wearing shoes. Such a partial sock, or half sock, is advantageous for uses including wearing with shoes that cover the forward portion of the foot only, such as open-heel and clog-type shoes.

25 Claims, 2 Drawing Sheets

PARTIAL SOCK

CROSS-REFERENCE TO RELATED APPLICATIONS

This application claims priority to applicants' abandoned Provisional Application Ser. No. 60/214,614, filed Jun. 28, 2000, which is hereby incorporated herein in full by reference.

FIELD OF THE INVENTION

The present invention relates to an article of apparel for a foot that covers the forward portion of the foot only. Embodiments of the present invention provide a partial sock, or half sock, advantageous for uses including wearing with shoes that cover the forward portion of the foot only.

BACKGROUND OF THE INVENTION

As footwear fashion trends change, consumers have developed an increased preference for wearing open-heel shoes. Open-heel shoes, including clog-type shoes, may be worn without any type of foot covering, such as socks, inside the shoes. However, many clog-type shoe designs can be uncomfortable when worn without a foot covering between the shoes and feet. Open-heel and clog-type shoes may be uncomfortable for a variety of reasons. For example, the fit of a shoe on a particular person's foot may cause friction between the inside surface of the shoe and the bare skin of the person's foot. Minor misalignments in shoe fit and loose-fitting shoes can result in shoe-skin friction causing undesirable skin irritations, such as blisters. Discomfort may also be caused by a natural build-up of moisture from a person's feet inside shoes. Moisture accumulation inside shoes increases shoe-skin friction and the negative effects of friction on skin. Generally, more moisture is generated in the toe area than in other areas of the foot. As clog-type shoes cover the toe area of the foot and are often constructed from non-breathing materials such as heavy leather and synthetics such as plastic, moisture accumulation can be a particularly difficult problem. In addition, moisture that accumulates inside shoes being worn can cause undesirable odors. As a result, persons wearing open-heel and clog-type shoes often desire to wear foot coverings between the shoes and their feet to absorb moisture and decrease friction.

As described above, ill-fitting shoes can slide on a person's feet while being worn. Since open-heel shoes have no means in the heel area to anchor the shoes to a person's feet, open-heel shoes tend to slide off while being worn more easily than shoes having closed heels. Consequently, due to construction design and/or fit, such shoes may move in an undesirable manner, including off a wearer's feet. Thus, it is often desirable to wear foot coverings inside open-heel and clog-type shoes to improve the fit of the shoes and to decrease the chance of the shoes inadvertently sliding off.

Wearing open-heel shoes without a foot covering inside the shoes can also be uncomfortable in certain climates because a wearer's feet may get cold. Thus, persons wearing open-heel shoes may prefer to wear foot coverings inside the shoes to help keep their feet warm.

To compensate for fit, moisture, friction, warmth, and other problems associated with open-heel shoes, traditional foot coverings have been used inside the shoes. However, a drawback of wearing traditional foot coverings with open-heel shoes is that previously available socks extend beyond the tops of the shoes onto the wearer's heels, ankles, and above. For a sock to show above a shoe is undesirable in many instances. Thus, use of traditional foot coverings, including above-the-ankle and ankle-high socks, with open-heel and clog-type shoes has often been unsatisfactory. For example, on certain occasions when open-heel shoes would be worn as a fashionable style, use of a foot covering that can be seen above the shoes would be contrary to that particular fashion. Therefore, consumers have a need for foot coverings that can be worn inside open-heel and clog-type shoes and that do not show above the tops of the shoes.

Foot coverings that do not show above the tops of shoes are useful in other applications as well. For example, a recent fashion trend involves rolling down the tops of socks, particularly ankle-high socks, below the tops of athletic, and other, shoes so as to provide a "no show" appearance. A "no show" style produced by rolling down the tops of socks into shoes, while fashionable, creates a problem of excessive sock fabric gathered in a relatively small area at the top margin of shoes. Such an increased thickness of material, which also may be gathered unevenly, may cause discomfort, constriction, unwanted irritation of skin at the affected area, and/or an ill shoe fit. As such, there is a need for foot coverings that do not show above the tops of shoes and that avoid problems, such as discomfort, associated with rolling socks down into shoes.

In the past, low-cut, sheer-type foot coverings have been used, for instance, as disposable foot coverings by customers when trying on shoes in a shoe store. Such sheer foot coverings would not show above the tops of some shoes, but are not suited to overcome fit, moisture, friction, warmth, and other problems associated with open-heel shoes described above. Sheer articles, usually knit on knitting machines having 400, or higher, needle counts, exhibit much slicker surfaces than less tightly knit fabrics, such as cotton and cotton blends typically used in socks. As a result, sheer foot coverings, particularly sheer foot coverings having open heels, tend to slide more easily relative to a foot and the inner surface of a shoe than more loosely knit foot coverings. Such sliding motion disadvantageously allows friction between a foot and shoe, whereas a more loosely knit foot covering may decrease foot-shoe friction.

In addition, previously used sheer foot coverings of partial length have also not had elastic materials incorporated into the middle area of the article, resulting in such sheer foot coverings tending to slide on a foot. Sheer articles also possess minimal moisture absorbency characteristics as compared to more loosely knit foot coverings, such as cotton socks, for example. Furthermore, sheer articles are substantially thinner and are much less able to provide a thickness sufficient to enhance fit and warmth than are more loosely knit fabrics, as in typical cotton socks. For these and other reasons, sheer foot coverings have not met consumers' needs for foot coverings that can be worn inside open-heel and clog-type shoes, that do not show above the tops of the shoes, and are comfort-fitting.

Other foot coverings that may not show above the tops of shoes also fail to meet such needs. For example, foot coverings made for purposes of insulation against cold and moisture and used in athletic footwear, such as skiing boots, may not show above the tops of the boots. Such sock structures are often made with materials, like neoprene, and with a thickness to provide for insulation that precludes any practical use with open-heel shoes.

Another disadvantage of previously available foot coverings that provide only partial foot coverage is construction with multiple seams. Use of multiple seams in a sock that covers the forward portion of a foot increases friction points between the foot, sock, and shoe. Foot coverings that do not show above the tops of open-heel shoes and that are comfort-fitting would need to minimize friction points due to seams.

Accordingly, there remains a need for a foot covering that covers the forward portion of a foot, that does not show above the tops of shoes, and that enhances fit and comfort of wearing shoes. There is also a need for a foot covering that covers the forward portion of a foot inside open-heel and clog-type shoes, that does not show above the tops of the shoes, and that overcomes the disadvantages related to fit, moisture, friction, and warmth associated with wearing no foot coverings and traditional foot coverings. There is also a need for a comfort-fitting foot covering that covers the forward portion of a foot inside open-heel and clog-type shoes, that does not show above the tops of the shoes, and that can be easily and economically manufactured and used. It is to these perceived needs that the present invention is directed.

SUMMARY OF THE INVENTION

The present invention relates to an article of apparel for a foot that covers the forward portion of the foot only. In an embodiment, the present invention comprises a foot covering that does not show above the tops of shoes and that enhances fit and comfort of wearing shoes, particularly open-heel and clog-type shoes.

In an embodiment of the present invention, a foot covering comprises toe, middle, and top portions. Embodiments of a partial sock foot covering comprise a length that extends only to the middle, or arch, area of a foot, and that does not show above the tops of shoes worn over the partial sock. Embodiments of foot coverings of the present invention comprise a thickness appropriate to assist a wearer with proper fit of shoes, to absorb moisture, and to reduce friction, and that can be comfortably used during all seasons of the year.

Embodiments of the present invention preferably comprise only one seam, for example, a toe seam on the upper surface of a sock. A toe seam differentiates the upper surface and the bottom surface of the sock and assists wearers in orienting such a sock for proper placement on their feet and thereby achieve better fit and comfort.

Partial sock foot coverings of the present invention may be include a variety of materials, such as cotton and cotton blends, which allow such partial socks to be comfortably worn during all seasons of the year. Embodiments of the present invention comprise elastomeric materials that increase the gripping force, fit, and tendency of such a sock to stay on a wearer's feet.

In embodiments of the present invention, a partial sock comprises a band extending from the proximal margin of the top portion. A band may include elastic material, which provides additional gripping force to help secure the sock in place on a wearer's foot.

In the present invention, embodiments of foot coverings that do not show above the tops of shoes comprise various sizes, colors, and designs and different lengths to accommodate different shoe constructions. Partial socks of the present invention comprise sizes proportioned to the forward portion of a foot to be covered by the sock.

Foot coverings of the present invention may be constructed using traditional sock manufacturing methods and techniques, for example, with a seamed toe closure on conventional circular knitting machinery.

In embodiments of the present invention, a partial sock comprises a "sling," or strap attached to opposite sides of the top portion of the sock. The strap provides a loop for fitting around a person's heel as a means for maintaining a partial sock on the person's foot. A heel strap can be permanently or removably attached to the sock using a variety of attachment means. Embodiments of heel straps comprise various materials, including elastomeric materials and/or transparent materials.

Features of foot coverings of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below. For example, the present invention advantageously provides foot coverings that cover the forward portion of a foot, leave the heel of a foot uncovered, and do not show above the tops of shoes. Thus, embodiments of the present invention provide a "no show" foot covering. As a result, foot coverings of the present invention may be worn with open-heel and clog-type shoes without exposing the foot covering above the tops of the shoes.

Another advantage of foot coverings of the present invention is that such partial socks can enhance the fit of ill-fitting shoes. Additionally, such partial foot coverings may help prevent shoes having no anchoring means at the heel, such as open-heel and clog-type shoes, from sliding off a wearer's foot. Consequently, foot coverings of the present invention enhance a wearer's comfort when wearing otherwise ill-fitting shoes or open-heel and clog-type shoes.

Another advantage of the present invention is that foot coverings that do not show above the tops of shoes, and would be desirable for wearing with open-heel shoes, absorb moisture and reduce friction between feet and shoes. Absorption of moisture, especially in the toe area, and reduction of friction between feet and shoes generally increase comfort. For example, as partial socks of the present invention absorb moisture and help keep feet dry, a wearer's feet have less tendency to stick to shoes.

The present invention provides the advantage of a foot covering that, while not showing above the tops of shoes, may provide warmth to a wearer's feet. Foot coverings of the present invention may be advantageously constructed with appropriate materials, knit density, thickness, and other factors so that such partial socks can be worn during all seasons of the year.

Another advantage of the present invention is that a "no show" foot covering is provided that is easy to put on by a wearer. Ease of placement of partial socks of the present invention is facilitated by the further advantage of having a toe seam on the upper surface of the socks that differentiates the upper and bottom surfaces of the socks. Differentiation of upper and bottom surfaces allows wearers to orient, and thus place, such socks on more easily.

Another advantage of foot coverings of the present invention is that such partial socks may be constructed so as to enhance the ability of the socks to stay on a person's feet when shoes are removed. The ability of partial socks to stay on a person's feet when shoes are removed is enhanced by appropriate sizing of such socks for particular wearers. In embodiments of the present invention, partial socks advantageously utilize elastic materials in part or all of the sock to help maintain the sock in place on the wearer's foot.

In the present invention, partial foot coverings provide the advantage of application with various types of shoes and in a variety of settings. As discussed above, partial foot coverings can be used with athletic shoes to provide a "no show" appearance, while also overcoming disadvantages of the practice of rolling traditional socks down inside shoes to achieve a similar look. Partial socks of the present invention provide the advantages of enhanced fit and decreased moisture and friction with the advantage of a "no show" look for a dressier appearance with fashion open-heel shoes.

Another advantage of the present invention is that foot coverings that cover only the forward portion of a foot increases comfort by avoiding a "binding" effect of the stretch of a sock from toes to heel.

Still another advantage of the present invention is that partial foot coverings that provide the above benefits can be easily and economically made using conventional manufacturing methods and techniques. The present invention overcomes disadvantages related to fit, moisture, friction, and warmth associated with wearing no foot coverings and traditional foot coverings by providing comfort-fitting, "no show" foot coverings that are also affordable to consumers.

As will be realized by those of skill in the art, many different embodiments of an article of apparel for the foot that covers the forward portion of the foot only according to the present invention are possible. For example, in addition to an embodiment of the present invention described herein as a half sock, the present invention may also comprise a sock that covers the forward three-fourths of a foot, the heel remaining open. Additional uses, objects, advantages, and novel features of the invention are set forth in the detailed description that follows and will become more apparent to those skilled in the art upon examination of the following or by practice of the invention.

DETAILED DESCRIPTION

Figure 1:
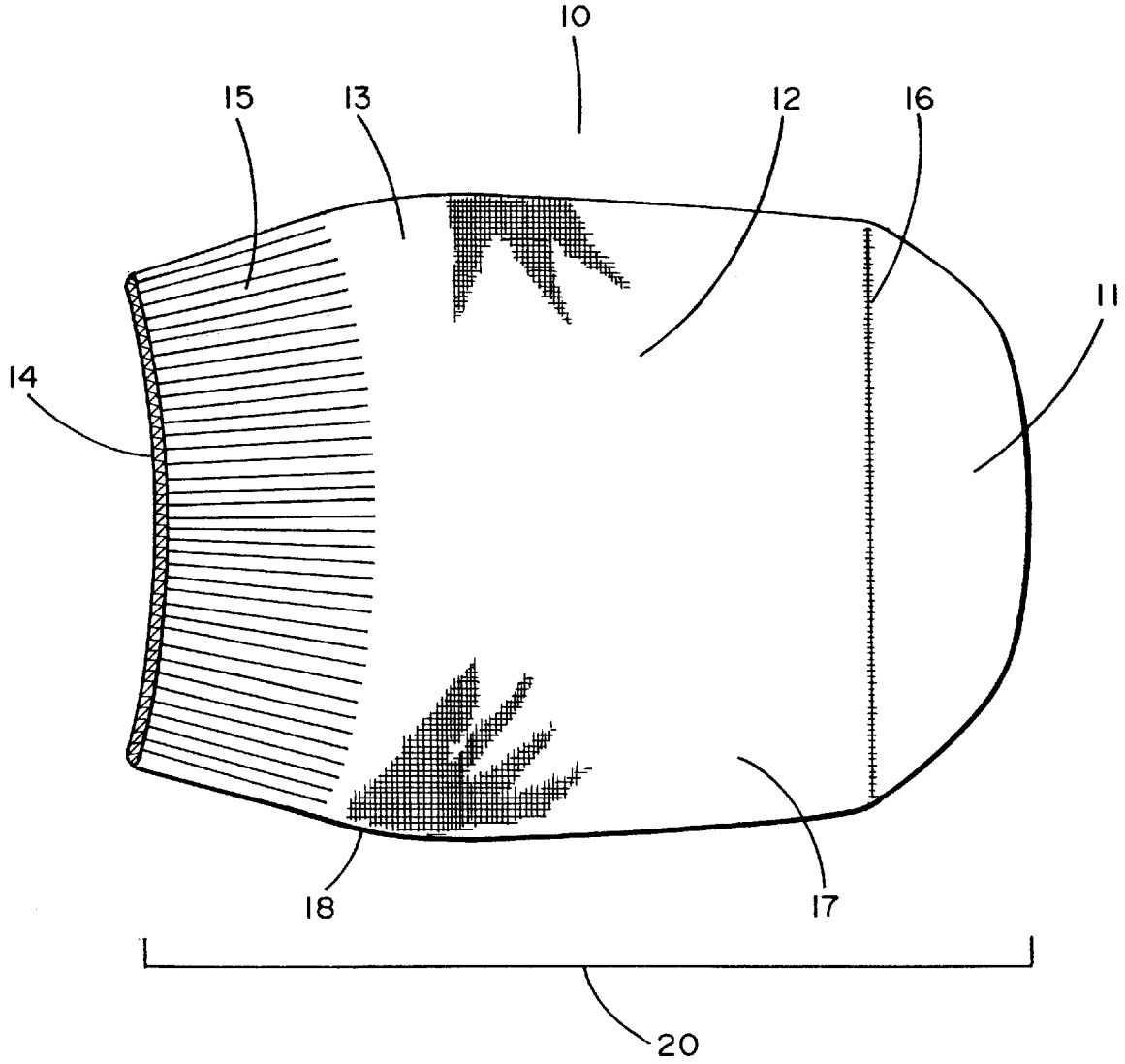
FIG. 1 is a view of an article of apparel for a foot in an embodiment of the present invention.

In an embodiment of the present invention, a foot covering comprises toe, middle, and top portions. The foot covering has a length such that the top portion extends only to the middle, or arch, area of a foot. In other embodiments, the top portion of a foot covering extends to a location on a foot more proximal to the heel. A foot covering of the present invention may thus be described as a partial sock, half sock, or demi-sock.

In the present invention, embodiments of a foot covering have a length that does not show above the tops of shoes worn over the foot covering and that fits comfortably on a foot for which it is made. Embodiments of foot coverings of the present invention comprise a thickness appropriate to assist a wearer with proper fit of shoes, to absorb moisture, and to reduce friction. Such embodiments of the present invention provide a comfort fit, including desirable moisture absorption and friction reduction characteristics, while avoiding being too bulky for wearing with open-heel shoes. Additionally, in embodiments, foot coverings of the present invention comprise a thickness that can be comfortably used during all seasons of the year.

Embodiments of the present invention are preferably constructed with only one seam, for example, a toe seam on the upper surface of the sock. A toe seam on the upper surface of a partial sock, as in the present invention, would differentiate the upper surface and the bottom surface, or sole, of the sock. Differentiation of the upper and bottom surfaces of a partial sock assists wearers in orienting such a sock for proper placement on their feet and thereby achieve better fit and comfort.

In embodiments of the present invention, a partial sock comprises a band extending downward from the proximal margin of the top portion. Preferably, a top band extends downward from the proximal margin for one inch or more. Such a band may be knit as a mock rib. In embodiments, a band comprises elastic material or materials. A band at the proximal margin of the top portion of a partial sock, as in the present invention, provides additional gripping force to help secure the sock in place on a wearer's foot.

Foot coverings of the present invention may be constructed using traditional sock manufacturing methods and techniques. For example, a partial sock may be flat knit with a seamed toe closure on conventional circular knitting machinery. In embodiments of the present invention, fabrication of a partial sock includes programming equipment for and discontinuing knitting, at a length to produce, for example, a half, or partial, sock. Partial socks of the present invention may be knit using 400 needle, or higher, knitting machines. In other embodiments, partial socks of the present invention may be produced on knitting machines with fewer needles, for example, 84, 108, and 132 needle machines. In embodiments, partial socks of the present invention are manufactured having a seamless toe closure. While conventional manufacturing methods and techniques may be used to make partial socks as in the present invention, such foot coverings have not been previously made.

Foot coverings of the present invention may be constructed with a variety of materials. For example, cotton and cotton blended with nylon, polyester, and/or other materials may be used. Embodiments of the present invention comprise such cotton blends to enhance strength and durability of the partial sock. Use of materials, including such cotton blends, in the present invention provides partial socks that can be comfortably worn during all seasons of the year.

In embodiments of the present invention, elastomeric yarn is utilized throughout a sock, including the toe, middle, and top portions, to increase the gripping force and fit of the sock on a wearer's foot. Elastomeric materials, such as spandex, may be knit, or incorporated using other conventional techniques, into the fabric of a partial sock. Use of elastic materials provides a partial sock with increased tendency to stay on a wearer's feet when shoes are removed. In other embodiments, elastomeric yarns are used in less than an entire partial sock, for example, limited to the middle, or arch, and top portions only. In embodiments, a tighter stitch in the band, top portion, and/or middle portion increases the ability of a partial sock to grip a wearer's foot.

In the present invention, embodiments of foot coverings that do not show above the tops of shoes comprise various sizes and colors. Embodiments of a partial sock, as in the present invention, include standard sizes for women's', men's', and children's' feet, as well as other sizes. Partial sock sizes include standard sizes used in the United States, Europe, Japan, and other countries. Embodiments of partial socks of the present invention comprise different lengths to accommodate different shoe constructions. Moreover, partial socks comprise sizes in proportion to the forward portion of a foot to be covered by the sock. In embodiments of the present invention, partial socks comprise colors including white, a range of other colors, and combinations of colors and/or designs. Such colors and/or designs may be intended for particular uses, for example, designating the color, name, and/or logo of an athletic team.

In embodiments of the present invention, a partial sock comprises a "sling," or strap. One end of the strap is attached to the medial aspect and the opposite end is attached to the lateral aspect of the top portion near the proximal margin of the sock. Preferably, the strap is attached to the top portion near and/or on the bottom surface a sock. The strap extends from one point of attachment to the other to provide a loop for fitting around a person's heel. The length of the strap is sized to fit snugly around a person's heel so that when in place, the strap provides a means for maintaining a partial sock on the person's foot. In experimental wear testing, 64% of participants found that partial socks of the present invention stayed in place when worn with shoes. A heel strap provides added security for retaining a partial sock for those unaccustomed to a short sock and/or those who perceive a partial sock might move out of position.

In embodiments of partial socks, a heel strap is attached to a sock using one, or a combination, of various conventional stitch patterns. For example, a heel strap can be effectively attached to a partial sock using a "bar tacking" technique for making strong point attachments. Alternatively, heel straps can be attached to partial socks using other means, such as by hand sewing. In other embodiments, heel straps comprise means for attaching and detaching the strap from a partial sock. As examples, a heel strap can be removably attached to a partial sock using buttons, snaps, or hook and loop-type fasteners. In still other embodiments, the present invention comprises a partial sock having a heel strap integrally made into the structure of the sock.

Partial socks of the present invention include embodiments having heel straps comprising various materials. For example, a heel strap of the present invention may comprise the same material as the partial sock to which the heel strap is attached. In embodiments, heel straps comprise cotton, polyester, nylon, spandex, and combinations thereof. Preferably, heel straps of the present invention include an elastomeric material to provide some degree of stretch for fitting the strap around a wearer's heel. In embodiments, heel straps comprise a transparent material so as to allow the color of the wearer's skin to show through the strap. A stretchable, transparent polyurethane material may be used for this purpose. Heel straps comprising such polymeric materials can be attached to a partial sock using thermal transfer techniques, such as with an ultrasonic heat transfer.

Embodiments of heel straps include various designs. For example, heel straps may be screen-printed, have powder adhered to the surface, contain reflective material, have lace attached, comprise various colors, display logos, etc. Embodiments of heel straps comprise various widths, from a narrow, shoestring-like width to a width sufficient to cover an entire heel. In preferred embodiments, heel straps are between one-fourth and one inch wide. In embodiments, heel straps of the present invention comprise a means for adjusting the length, or tension, of the strap. For example, two ends of a heel strap may be looped through a clasp, which can be used to adjust the length of the strap.

Figure 2:
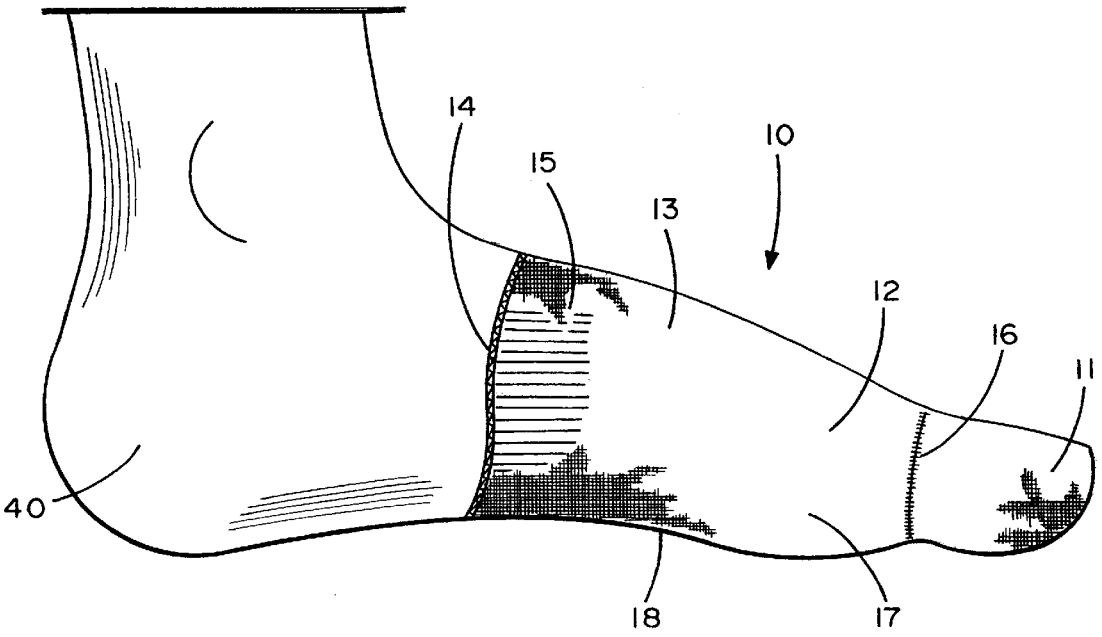
FIG. 2 is a view of the article of apparel for a foot of FIG. 1 in an embodiment of the present invention shown on a wearer's foot.

Referring to FIGS. 1 and 2, in embodiments of the present invention, a foot covering, or article of apparel for a foot, comprises a sock 10 having a toe portion 11, a middle portion 12, a top portion 13, and a length 20 extending from toe portion 11 to top portion 13. The length 20 of sock 10 terminates at a location distal to heel area 40 on the foot so as to leave heel 40 uncovered. Preferably, sock length 20 is less than a length of an open heel shoe (not shown) so that when sock 10 is worn with the open heel shoe, sock 10 is contained completely within the shoe. As such, embodiments of the present invention comprise a sock length 20 that does not show above the tops of shoes.

In embodiments, sock 10 comprises a thickness sufficient to promote proper fit of the open heel shoe on a wearer. In addition to assisting a wearer with proper fit of shoes, such thickness preferably helps absorb moisture and reduce friction. In embodiments, sock 10 comprises a thickness that can be comfortably used during all seasons of the year.

Sock 10 may comprise cotton and/or cotton blends. For example, sock 10 may include cotton and cotton blended with nylon, polyester, and/or other materials. Such materials enhance strength and durability of the sock and allow partial socks of the present invention to be comfortably worn during all seasons of the year.

In other embodiments, sock 10 comprises elastomeric material in top portion 13, middle portion 12, and/or toe portion 11. Elastomeric yarn increases the gripping force and fit of sock 10 on a wearer's foot and thus increases the tendency for sock 10 to stay on a wearer's foot while worn with a shoe and when a shoe is removed.

The present invention includes embodiments having a top portion 13 of sock 10 further comprising a band 15 of material extending from proximal margin 14 of top portion 13. Such a band 15 provides additional gripping force and promotes removably securing sock 10 to a foot. Preferably, top band 15 extends from proximal margin 14 for one inch or more. Top portion 13 and band 15 may both include elastomeric material. In some embodiments, band 15 comprises a greater amount of elastomeric material than the remainder of top portion 13. Such a band 15 may be knit as a mock rib. In embodiments, band 15 may include a tighter stitch than the remainder of the sock.

In embodiments, sock 10 comprises an upper surface 17 and a bottom surface 18, or sole, and a seam 16 on upper surface 17 of toe portion 11. Embodiments of the present invention preferably comprise only one seam, for example, a toe seam 16 on upper surface 17 of sock 10. A toe seam on the upper surface of a partial sock, as in the present invention, differentiates upper surface 17 and bottom surface 18 of sock 10. Differentiation of the upper and bottom surfaces of a partial sock assists wearers in orienting such a sock for proper placement on their feet and thereby achieve better fit and comfort.

Figure 3:
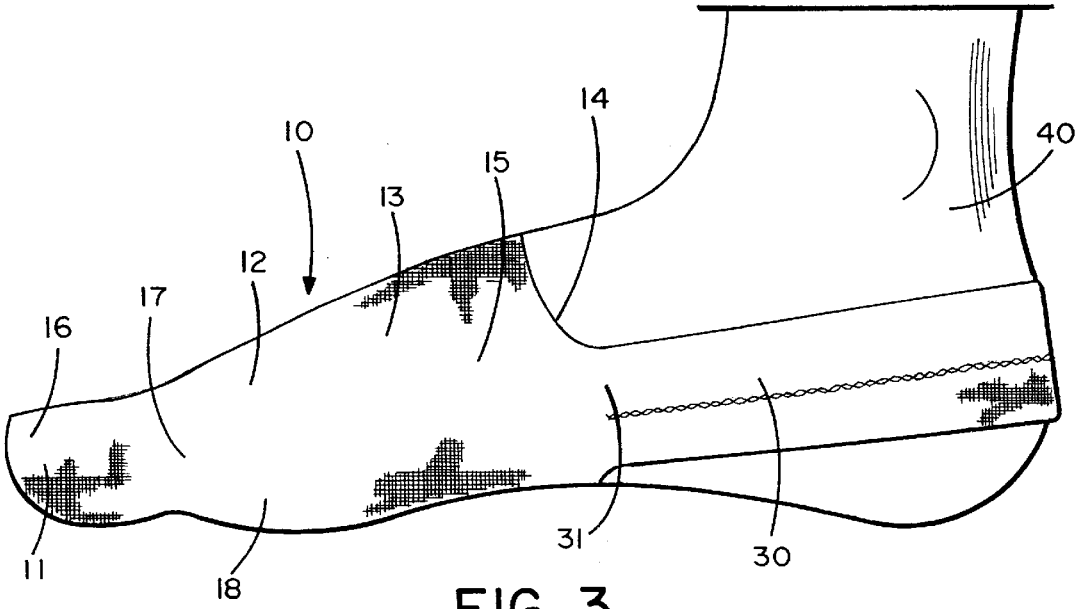
FIG. 3 is a view of an article of apparel for a foot having an attached heel strap in an embodiment of the present invention shown on a wearer's foot.

Referring to FIG. 3, embodiments of sock 10 further comprise a strap 30 having opposite ends, one end of which is shown at 31. Each end 31 is attached to an opposite side of top portion 13 near proximal margin 14 of sock 10 to provide a loop for fitting strap 30 around heel 40. In FIG. 3, end 31 is shown attached to the medial aspect of sock 10 on top portion 13 near and/or on bottom surface 18. Not shown is the opposite end of strap 30, which is attached in the same or similar position on the lateral aspect of sock 10. Preferably, strap 30 comprises a length sized to fit snugly around heel 40 so that when in place, strap 30 provides a means for maintaining sock 10 on a foot. Heel straps 30 comprise a width sufficient to comfortably and/or decoratively hold a partial sock in place. In preferred embodiments, the width of strap 30 is between one-fourth and one inch wide.

In embodiments, strap 30 comprises elastomeric material, which helps provide stretch for a snug fit and added security for retaining a partial sock on a wearer's foot. In embodiments, strap 30 comprises a transparent material, which is advantageous for allowing the color of a wearer's skin to show through the strap.

Strap 30 of the present invention can be permanently attached to sock 10 in various ways, including stitching with various patterns. In embodiments, strap 30 comprises a means for removably attaching strap 30 to sock 10, such as with buttons, snaps, or hook and loop-type fasteners. In other embodiments, a partial sock comprises a heel strap 30 integrally made into the structure of sock 10. Strap 30 may further include a means for adjusting the length, or tension, of the strap, such as looping strap 30 through a clasp (not shown).

Experimental wear testing with two focus groups demonstrated optimal design characteristics for best performance of partial socks according to the present invention. Testing showed, for example, that increasing thickness in a cushioned embodiment provides increased comfort, though too great a thickness decreases fit inside a shoe. When comparing partial socks of the present invention made on knitting machines having 132 needles, 108 needles, and 84 needles, wearers reported generally more comfort with partial socks made on the lower needle count machines. Test data showed that a wider band having an increased amount of elastic material at the proximal margin of the top portion provides an improved grip against a wearer's foot, and the partial sock having a band of about one inch was better retained on a foot. The partial socks were rated as comfortable by 73% of participants. Thus, the present invention provides an article of apparel for a foot that covers the forward portion of the foot only, that does not show above the tops of shoes, and that enhances fit and comfort of wearing shoes, particularly open-heel and clog-type shoes.

Although the present invention has been described with reference to particular embodiments, it should be recognized that these embodiments are merely illustrative of the principles of the present invention. Those of ordinary skill in the art will appreciate that the partial sock of the present invention may be constructed and implemented in other ways and embodiments. Accordingly, the description herein should not be read as limiting the present invention, as other embodiments also fall within the scope of the present invention.

What is claimed is:

1. An article of apparel for a foot, comprising:

a sock having a toe portion, a middle portion, and a top portion, the top portion spaced from the toe portion a distance that determines a length of the sock, wherein the length of the sock is adapted to leave the heel of the foot uncovered;

wherein the length of the sock is less than a length of an open heel shoe so that when the sock is worn with the open heel shoe the sock is contained completely within the open heel shoe and is not visible;

wherein the sock further comprises a thickness sufficient to promote proper fit of the open heel shoe;

the top portion of the sock further comprising a proximal margin, wherein the sock further comprises a band of material integrally knit with the sock and extending from the proximal margin of the top portion so that the band of material promotes removable securing the sock to the foot;

wherein the sock further comprises electrometric material;

the sock further comprising a knit construction and an upper surface and a bottom surface, wherein the sock further comprises a seam on the upper surface of the toe portion; and wherein the sock further comprises a size proportioned for a particular size foot.

2. The article of apparel for a foot of claim 1, wherein the band further comprises a greater amount of elastomeric material than the remainder of the sock.

3. The article of apparel for a foot of claim 1, wherein the band comprises a tighter stitch than the remainder of the sock.

4. The article of apparel for a foot of claim 1, wherein the sock further comprises a strap having opposite ends, each end attached to an opposite side of the top portion near the proximal margin of the sock to provide a loop for fitting the strap around the heel.

5. The article of apparel for a foot of claim 4, wherein the strap further comprises a length sized to fit snugly around the heel so that when in place, the strap provides a means for maintaining the sock on the foot.

6. The article of apparel for a foot of claim 4, wherein the strap further comprises elastomeric material.

7. The article of apparel for a foot of claim 4, wherein the strap further comprises a transparent material.

8. An article of apparel for a foot, comprising:

a sock having a toe portion, a middle portion, and a top portion, the top portion spaced from the toe portion a distance that determines a length of the sock, wherein the length of the sock is adapted to leave the heel of the foot uncovered; and wherein the length of the sock is less than a length of an open heel shoe so that when the sock is worn with the open heel shoe the sock is contained completely within the open heel shoe and is not visible;

the top portion of the sock further comprising a proximal margin, the sock further comprising a band of material integrally knit with the sock and extending from the proximal margin of the top portion to promote removable securing the sock to the foot.

9. The article of apparel for a foot of claim 8, wherein the sock further comprises a thickness sufficient to promote proper fit of the open heel shoe.

10. The article of apparel for a foot of claim 8, wherein the sock further comprises cotton.

11. The article of apparel for a foot of claim 10, wherein the sock further comprises cotton blends.

12. The article of apparel for a foot of claim 8, wherein the middle and top portions of the sock comprise electrometric material.

13. The article of apparel for a foot of claim 12, wherein the toe portion comprises elastomeric material.

14. The article of apparel for a foot of claim 8, wherein the top portion and the band comprise electrometric material.

15. The article of apparel for a foot of claim 14, wherein the band further comprises a greater amount of elastomeric material than the remainder of the top portion.

16. The article of apparel for a foot of claim 8, the sock further comprising a knit construction, wherein the band comprises a tighter stitch than the remainder of the top portion.

17. The article of apparel for a foot of claim 8, the sock further comprising a knit construction and an upper surface and a bottom surface, and wherein the sock further comprises a seam on the upper surface of the toe portion.

18. The article of apparel for a foot of claim 8, wherein the sock further comprises a size proportioned for a particular size foot.

19. The article of apparel for a foot of claim 8, wherein the sock further comprises a strap having opposite ends, each end attached to an opposite side of the top portion near the proximal margin of the sock to provide a loop for fitting the strap around the heel.

20. The article of apparel for a foot of claim 19, wherein the strap further comprises a length sized to fit snugly around the heel so that when in place, the strap provides a means for maintaining the sock on the foot.

21. The article of apparel for a foot of claim 19, wherein the strap further comprises elastomeric material.

22. The article of apparel for a foot of claim 19, wherein the strap further comprises a transparent material.

23. The article of apparel for a foot of claim 19, wherein the strap is removably attached to the sock.

24. The article of apparel for a foot of claim 19, wherein the strap is integrally made with the sock.

25. The article of apparel for a foot of claim 19, wherein the strap further comprises a strap length adjustment means.

* * * * *

UNITED STATES PATENT AND TRADEMARK OFFICE

CERTIFICATE OF CORRECTION

PATENT NO. : 6,393,620 B2
DATED : May 28, 2002
INVENTOR(S) : Hatch et al.

It is certified that error appears in the above-identified patent and that said Letters Patent is hereby corrected as shown below:

Column 7,
Lines 63-67, please replace the sentence with the following sentence:

-- Referring to Figures 1 and 2, in embodiments of the present invention, a foot covering, or article of apparel for a foot, comprises a sock 10 having a toe portion 11, a middle portion 12, a top portion 13, the top portion 13 spaced from the toe portion 11 a distance that determines a length 20 of the sock --.

Column 9, lines 44-67 and Column 10, lines 1-22,
Please renumber claims 1-7 as claims 19-25, respectively.

Column 10,
Lines 3, 6 and 9, please renumber claim “1” as claim -- 19 --.
Lines 15, 19 and 21, please renumber claim “4” as claim -- 22 --.
Lines 40, 43, 47, 52, 57, 61 and 65, please renumber claim “8” as claim -- 1 --.
Line 45, please renumber claim “10” as claim -- 3 --.
Line 50, please renumber claim “12” as claim -- 5 --.
Line 54, please renumber claim “14” as claim -- 7 --.

Column 10, lines 23-67 to Column 12, line 10,
Please renumber claims respectively.

Column 11,
Line 1, please renumber claim “8” as claim -- 1 --.
Lines 6 and 10, please renumber claim “19” as claim -- 12 --.

UNITED STATES PATENT AND TRADEMARK OFFICE

CERTIFICATE OF CORRECTION

PATENT NO. : 6,393,620 B2
DATED : May 28, 2002
INVENTOR(S) : Hatch et al.

It is certified that error appears in the above-identified patent and that said Letters Patent is hereby corrected as shown below:

Column 12,
Lines 1, 3, 5 and 7, please renumber claim "19" as claim -- 12 --.

Signed and Sealed this

Twenty-sixth Day of November, 2002

*Attest:*

*Attesting Officer*

JAMES E. ROGAN
*Director of the United States Patent and Trademark Office*